US012318826B2

(12) United States Patent
Matsubara et al.

(10) Patent No.: US 12,318,826 B2
(45) Date of Patent: Jun. 3, 2025

(54) COLD-ROLLED STEEL STRIP MANUFACTURING FACILITY AND METHOD FOR MANUFACTURING COLD-ROLLED STEEL STRIP

(71) Applicant: JFE STEEL CORPORATION, Tokyo (JP)

(72) Inventors: Yukihiro Matsubara, Tokyo (JP); Daiki Hioka, Tokyo (JP); Noriki Fujita, Tokyo (JP); Tetsuya Arakawa, Tokyo (JP); Masaki Hirai, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 257 days.

(21) Appl. No.: 17/800,929

(22) PCT Filed: Nov. 17, 2020

(86) PCT No.: PCT/JP2020/042690
§ 371 (c)(1),
(2) Date: Aug. 19, 2022

(87) PCT Pub. No.: WO2021/205687
PCT Pub. Date: Oct. 14, 2021

(65) Prior Publication Data

US 2023/0080012 A1 Mar. 16, 2023

(30) Foreign Application Priority Data

Apr. 7, 2020 (JP) ..... 2020-069002

(51) Int. Cl.
*B21B 15/00* (2006.01)
*B21B 1/22* (2006.01)

(52) U.S. Cl.
CPC ..... *B21B 1/22* (2013.01); *B21B 15/0085* (2013.01); *B21B 2001/221* (2013.01)

(58) Field of Classification Search
CPC .. B21B 15/0085; B21B 2001/221; B21B 1/28
See application file for complete search history.

(56) References Cited

U.S. PATENT DOCUMENTS 10,207,303 B2 2/2019 Ueno et al.
2016/0332203 A1 11/2016 Ueno et al.

FOREIGN PATENT DOCUMENTS

EP 3097990 A1 11/2016
JP S53-118259 A 10/1978
(Continued)

OTHER PUBLICATIONS

Dec. 22, 2020 International Search Report issued in International Patent Application No. PCT/JP2020/042690.
(Continued)

*Primary Examiner* — Debra M Sullivan
(74) *Attorney, Agent, or Firm* — Oliff PLC

(57) ABSTRACT

A cold-rolled steel strip manufacturing facility includes: a joining device configured to join a trailing end of a preceding steel strip and a leading end of a following steel strip to form a joined steel strip; a looper configured to store the joined steel strip; a heating device configured to heat a joint portion between the preceding steel strip and the following steel strip over an entire width direction; and a cold rolling mill configured to cold-roll the joined steel strip for which the joint portion was heated by the heating device, wherein the heating device is switchable between an output state and a non-output state, and during a period in which the joint portion passes through the heating device, is switched to the output state.

2 Claims, 1 Drawing Sheet

(56) References Cited

FOREIGN PATENT DOCUMENTS

| | | | | | |
|---|---|---|---|---|---|
| JP | 59185502 | A | * | 10/1984 | ..... B21B 1/28 |
| JP | S59-185502 | A | | 10/1984 | |
| JP | H05-161901 | A | | 6/1993 | |
| JP | H07-124611 | A | | 5/1995 | |
| JP | 3249267 | B2 | * | 1/2002 | |
| JP | 2004-209497 | A | | 7/2004 | |
| JP | 2011-140026 | A | | 7/2011 | |
| JP | 2013-027934 | A | | 2/2013 | |
| JP | 2014-050853 | A | | 3/2014 | |
| KR | 10-2016-0099687 | A | | 8/2016 | |
| TW | 442344 | B | | 6/2001 | |

OTHER PUBLICATIONS

Oct. 21, 2021 Office Action issued in Taiwanese Patent Application No. 109144355 .

Jun. 15, 2023 Search Report issued in European Patent Application No. 20930267.8.

May 25, 2024 Office Action issued in Chinese Patent Application No. 202080097981.X.

Nov. 8, 2024 Office Action issued in Korean Patent Application No. 10-2022-7029464.

* cited by examiner

COLD-ROLLED STEEL STRIP MANUFACTURING FACILITY AND METHOD FOR MANUFACTURING COLD-ROLLED STEEL STRIP

FIELD

The present invention relates to a cold-rolled steel strip manufacturing facility and a method for manufacturing cold-rolled steel strip.

BACKGROUND

In a cold rolling line for steel strips, the trailing end of a leading material (preceding steel strip) and the leading end of a trailing material (following steel strip) are joined, and by continuously supplying the joined steel strip into a cold rolling mill, cold rolling is performed without interruption. Then, by rolling the steel strip in a state in which tension is applied over the entire length of the steel strip, thickness and shape can be controlled with high precision, even at the leading end and the tail end of the steel strip.

With the advancement of laser welding machines, the fact that the leading material and the trailing material are joined by laser welding is becoming mainstream, and the strength and workability of the joint portion of the steel strip after joining have been improved. However, with the progress of high alloying and thinning of steel strips, the probability of occurring fracture at the joint portion of the steel strip during cold rolling has been increasing. Fracture at the joint portion of the steel strip leads to stopping of the cold rolling line, resulting in a significant decrease in productivity. In addition, a need to replace the work rolls also arises, which leads to an increase in production costs.

Therefore, conventionally, in order to prevent fracture at the joint portion of the steel strip, measures such as optimizing welding conditions according to the alloy content and thickness of the steel strip have been taken. For example, Patent Literature 1 discloses a method for stably rolling a joint portion by defining the supply conditions of a welding filler and by optimizing the shape and hardness of the weld metal when joining steel strips. Furthermore, Patent Literature 2 discloses a method for stably rolling a joint portion by performing notching on a joint portion of the steel strip using a laser and by suppressing work hardening of the cross-section of the steel strip during notching.

CITATION LIST

Patent Literature

[Patent Literature 1] Japanese Patent Application Laid-open No. 2011-140026

[Patent Literature 2] Japanese Patent Application Laid-open No. 2014-50853

SUMMARY

Technical Problem

As in the foregoing, many techniques for stably passing a joint portion when rolling a silicon steel sheet having a high Si content have been developed. However, although the conventionally developed methods provide a certain effect, the current situation is that it has not been able to prevent the fracture of the joint portion during cold rolling to an operationally acceptable level.

The present invention has been made in view of the foregoing, and an object of the present invention is to provide a cold-rolled steel strip manufacturing facility and a method for manufacturing cold-rolled steel strip capable of suppressing the occurrence of fracture of a joint portion during cold rolling of a silicon steel sheet.

Solution to Problem

As a result of diligent studies to achieve the above-described object, the inventors found that only optimizing the strength of the joint portion and the notching method is not enough in order to stably cold-roll the joint portion of a silicon steel sheet and that controlling the rolling temperature of the joint portion is highly effective, which led to the following invention.

To solve the above-described problem and achieve the object, a cold-rolled steel strip manufacturing facility according to the present invention includes: a joining device configured to join a trailing end of a preceding steel strip and a leading end of a following steel strip to form a joined steel strip; a looper configured to store the joined steel strip; a heating device configured to heat a joint portion between the preceding steel strip and the following steel strip over an entire width direction; and a cold rolling mill configured to cold-roll the joined steel strip for which the joint portion was heated by the heating device, wherein the heating device is switchable between an output state and a non-output state, and during a period in which the joint portion passes through the heating device, is switched to the output state.

Moreover, in the above-described cold-rolled steel strip manufacturing facility according to the present invention, a pickling device configured to pickle the joined steel strip is arranged between the looper and the heating device.

Moreover, in the above-described cold-rolled steel strip manufacturing facility according to the present invention, when a Si content of a steel strip, out of the preceding steel strip and the following steel strip, having a higher Si content is below 3 mass %, the heating device heats the joint portion so that a temperature of the joint portion at an entrance side of the cold rolling mill is to be 35° C. or higher.

Moreover, in the above-described cold-rolled steel strip manufacturing facility according to the present invention, when a Si content of at least one of the preceding steel strip and the following steel strip is 2 mass % or more, the heating device heats the joint portion so that a temperature of the joint portion at an entrance side of the cold rolling mill is to be 50° C. or higher.

To solve the above-described problem and achieve the object, a method for manufacturing cold-rolled steel strip performing processes in sequence according to the present invention include: a joining step of, by a joining device, joining a trailing end of a preceding steel strip and a leading end of a following steel strip to form a joined steel strip; a storage step of, by a looper, storing the joined steel strip; a heating step of, by a heating device, heating a joint portion between the preceding steel strip and the following steel strip over an entire width direction; and a cold rolling step of, by a cold rolling mill, cold rolling the joined steel strip for which the joint portion was heated by the heating device, wherein the heating device is switchable between an output state and a non-output state, and the heating step switches the heating device to the output state, during a period in which the joint portion passes through the heating device.

Moreover, in the method for manufacturing cold-rolled steel strip according to the present invention, a pickling step in which the loined steel strip is pickled by a pickling device is performed, between the storage step and the heating step.

Moreover, in the method for manufacturing cold-rolled steel strip according to the present invention, when a Si content of a steel strip, out of the preceding steel strip and the following steel strip, having a higher Si content is below 3 mass %, the heating device heats the joint portion so that a temperature of the joint portion at an entrance side of the cold rolling mill is to be 35° C. or higher.

Moreover, in the method for manufacturing cold-rolled steel strip according to the present invention, when a Si content of at least one of the preceding steel strip and the following steel strip is 2 mass % or more, the heating device heats the joint portion so that a temperature of the joint portion at an entrance side of the cold rolling mill is to be 50° C. or higher.

Advantageous Effects of Invention

According to the present invention, the occurrence of fracture of a joint portion during cold rolling of a silicon steel sheet can be suppressed, so that the joint portion of the silicon steel sheet can be stably cold-rolled.

DESCRIPTION OF EMBODIMENTS

Figure 1:
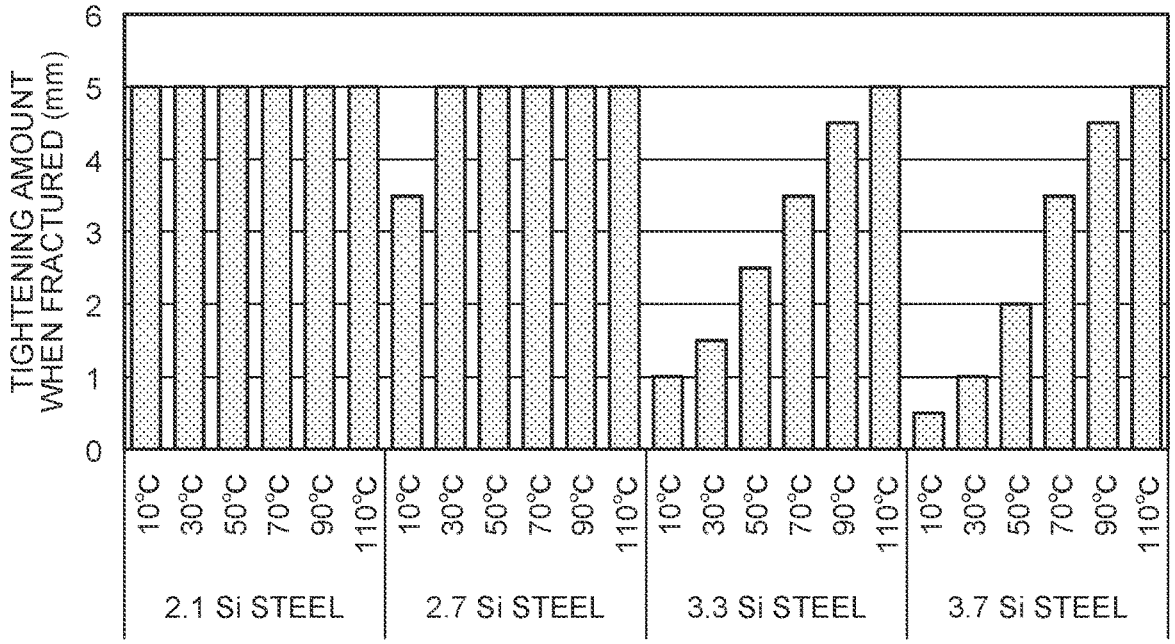
FIG. 1 is a graph illustrating the effect of steel strip temperature on bending cracks at a joint portion.

A cold-rolled steel strip manufacturing facility and a method for manufacturing cold-rolled steel strip according to an embodiment of the present invention will be described with reference to the drawings. The constituent elements in the following embodiment include those that can be easily replaced by those skilled in the art, or those that are substantially the same.

The inventors first investigated stands at which the fracture occurs in a joint portion when the joint portion of a steel strip is cold-rolled by a tandem rolling mill having five rolling stands. As a result, it was found that in some cases, the fracture occurs in the stand on the upstream side such as #1 std (hereinafter, the Nth stand from the upstream side in the transport direction of the steel strip is referred to as "#N std") and #2 std, while in other cases, the fracture occurs in the stand on the downstream side such as #4 std and #5 std.

In addition, as a result of the diligent investigation of the cause of each fracture, it was found that the cause of fracture is different between the case of fracture in the stand on the upstream side and the case of fracture in the stand on the downstream side. As the cases of fracture in the stand on the downstream side, there were many cases of the fracture caused by edge cracking originating at the width end portion of the joint portion, or cases of the fracture due to changes in the cross-sectional shape of the weld metal. When these are the causes of fracture, it is possible to suppress the fracture by the methods described in the above-described Patent Literature 1 and Patent Literature 2.

Meanwhile, in the stand on the upstream side, edge cracking at the width end portion and changes in the cross-sectional shape of the weld metal are unlikely to occur. Thus, as a result of the further diligent investigation on the cause of the fracture, particularly on the fracture at the joint portion immediately below the #1 std or on the exit side thereof, it was presumed that the causes were local drawing of the steel strip shape such as center elongation and edge elongation or bending deformation at sheet passing rolls or a shape detector. That is, it was presumed that a local brittle breakage occurs in the weld metal portion when the joint portion is rolled at the #1 std, which leads to the fracture due to local drawing, bending strain between the stands, or the like.

As a result of further investigation of fracture of a joint portion in the stand on the upstream side, the fracture rate (fracture occurrence rate) differs depending on the season; for example, the fracture rate is higher in winter than that in summer, and thus it was presumed that the outside air temperature (temperature in the roiling plant) affects the fracture rate. In the present embodiment, "fracture rate" indicates the fracture rate in the stand on the upstream side, and the presence of fracture in the stand on the downstream is not considered.

In order to verify the above-described theory, the bending crack resistance of a joint portion when the bending strain was applied to the joint portion was evaluated on a laboratory scale. This is because the bending crack resistance in this experiment is considered to have a correlation with the cracking property at the time of local drawing during rolling and the cracking property at the time of roll bending as in the foregoing.

As the test materials, four types of silicon steel strips, each of which has a sheet thickness of 2 mm and Si content of 2.1 mass %, 2.7 mass %, 3.3 mass %, and 3.7 mass % (hereinafter mass % is referred to simply as "%"), were annealed at 800° C. (corresponding to hot-rolled sheet annealing). Then, the annealed silicon steel strips were pickled and joined using a laser welder, and then the test materials having a width of 30 mm and a length of 300 mm were cut out.

The 2.1% and 2.7% silicon steel strips (hereafter, M % silicon steel strip is referred to as "M % Si steel") are of steel grades in which fracture is unlikely to occur in an actual continuous cold rolling line. Meanwhile, the 3.3% and 3.7% silicon steel strips are of steel grades in which the joint portion is fractured at a frequency of about several percent, particularly in the stands on the upstream side, in the actual continuous cold rolling line. Normally, in cold rolling, the temperature of the steel strip on the entrance side of the rolling mill is about the same as the temperature in the plant, and in winter, it is around 10° C. Therefore, with regard to the bending crack resistance of the joint portion, the temperature dependence when the steel strip temperature (that is, the temperature of the joint portion) is in the range of 10 to 110° C. was investigated.

In this experiment, by passing the 2 mm-thick steel strip through a roller leveler, the bending crack resistance was evaluated. The roller leveler includes nine work rolls having a diameter of 70 mm at the top and bottom, and a roll interval is 100 mm. The bending stress on the steel sheet surface can be varied by changing the tightening amount of the upper work rolls.

In this experiment, the steel sheet temperature was changed in increments of 20° C. and the tightening amount was varied in increments of 0.5 mm, and the fracture limit of the joint portion was organized. It is considered that, the greater the tightening amount at the time of fracture, the more difficult fracturing becomes even in the cold rolling line. FIG. 1 indicates the results obtained in this experiment.

As illustrated in FIG. 1, when compared for each Si content, with 2.1% Si steel, the fracture occurred at a tightening amount of 5.0 mm, regardless of the temperature of the joint portion. Furthermore, with 2.7% Si steel, the fracture occurred at a tightening amount of 3.5 mm when the temperature of the joint portion was 10° C., but when exceeding 30° C., the fracture did not occur up to a tightening amount of 5.0 mm.

With 3.3% Si steel, the fracture occurred at a tightening amount of 1.0 mm when the temperature of the joint portion was 10° C., and thereafter, for each rise of 20° C., the fracture occurred at 1.5 mm, 2.5 mm, 3.5 mm, 4.5 mm, and 5.0 mm. With 3.7% Si steel, the fracture occurred at a tightening amount of 0.5 mm when the temperature of the joint portion was 10° C., and thereafter, for each rise of 20° C., the fracture occurred at 1.0 mm, 2.0 mm, 3.5 mm, 4.5 mm, and 5.0 mm.

As a result of the above-described experiment, it was confirmed that the Si content has a significant effect on the fracture property of the joint portion, and that, as the Si content is higher, the joint portion also is more likely to fracture. This also coincides with the reality of the fracture in an actual continuous cold rolling mill. In particular, with 3.3% Si steel and 3.7% Si steel, as a result of experiment conducted while changing the temperature of the joint portion, it was found that the weld fracture can be suppressed as the temperature is higher, and that when heated up to 50° C., the fracture did not occur up to a tightening amount of 2.0 mm. In addition, it was found that when heated up to 70° C., the fracture of the joint portion did not occur up to a tightening amount of 3.5 mm.

From this, it was found that when cold rolling the silicon steel sheet having a Si content of 3% or more, by heating up the joint portion to 50° C. or higher before cold rolling, the fracture of the joint portion can be sufficiently suppressed. Although the upper limit of the heating temperature is not restricted from the viewpoint of preventing the fracture of the joint portion, because the cold rolling is performed thereafter, there is a need to set the temperature lower than the temperature that is not suitable for cold rolling and it is preferable to be 150° C. or lower, for example. As in the foregoing, it was found that the bending crack property of the joint portion is greatly affected by the Si content of the base material and the heating temperature of the joint portion, whch led to the completion of the present invention.

Cold-Rolled Steel Strip Manufacturing Facility

Figure 2:
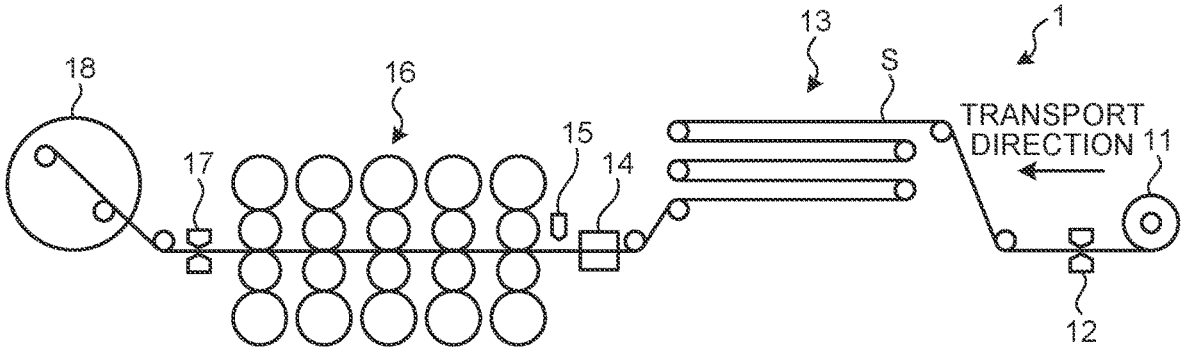
FIG. 2 is a diagram illustrating a schematic configuration of a cold-rolled steel strip manufacturing facility according to an embodiment of the present invention.

Next, the configuration or the cold-rolled steel strip manufacturing facility (hereinafter simply referred to as "manufacturing device") according to the present embodiment will be described. FIG. 2 illustrates an example of the configuration of a manufacturing facility 1. The manufacturing facility 1 includes a dispensing machine 11, a joining device 12, a looper 13, a heating device 14, a thermometer (sheet temperature measuring device) 15, a cold rolling mill 16, a cutting machine (cutting device) 17, and a winding machine 18 arranged in the foregoing order. The manufacturing facility 1 is a facility that dispenses a steel strip by the dispensing machine 11, passes it through the joining device 12, the looper 13, and the cold rolling mill 16, and winds up the cold-rolled steel strip by the winding machine 18. Hereinafter, each apparatus will be described.

The dispensing machine 11 is an apparatus responsible for the process of dispensing steel strips (dispensing process) and is loaded with a heat-retaining coil. The manufacturing facility 1 may be equipped with a plurality of dispensing machines 11. In this case, the dispensing machines 11 each dispense different steel strips.

The joining device 12 is an apparatus responsible for the process of joining (welding) the trailing end of a preceding steel strip that is dispensed by the dispensing machine 11 and precedes and a leading end of the following steel strip that is dispensed by the dispensing machine 11 and trails so as to form a joined steel strip S (joining process). As the joining device 12, a laser welder as in the foregoing is suitably used.

The looper 13 is an apparatus responsible for the process of storing the joined steel strip S (storage process) so that the cold rolling can be continued by the cold rolling mill 16 until the steel strips are joined by the joining device 12 (until joining is completed).

The heating device 14 is an apparatus responsible for the process of heating the joint portion between the preceding steel strip and the following steel strip over the entire width direction (heating process) in the joned steel strip S. The heating device 14 is configured to be switchable between an output state in which the passing object passing through the heating device 14 is heated and a non-output state in which the passing object is not heated.

The heating device 14 is switched to the output state for the period during which the joint portion of the steel strip S passes through the relevant heating device 14. That is, the heating device 14 is switched to the output state (a state of heating the passing object) during the period in which the joint portion passes through the relevant heating device 14. The heating device 14 is switched to the non-output state (a state in which the passing object is not heated) in other periods (the period in which the joint porton does not pass through the heating device 14).

In the heating process, it is preferable that when the Si content of the steel strip, out of the preceding steel strip and the following steel strip, having a higher Si content is below 3%, the heating device 14 heats the relevant joint portion so that the temperature of the joint portion on the entrance side of the cold rolling mill 16 is 35° C. or higher. This makes it possible to suppress the fracture of the joint portion more effectively.

Furthermore, in the heating process, it is preferable that when the Si content of at least one of the preceding steel strip and the following steel strip is 2% or higher, the heating device 14 heats the relevant joint portion so that the temperature of the joint portion on the entrance side of the cold rolling mill 16 is 50° C. or higher. This makes it possible to suppress the fracture of the joint portion more effectively.

The thermometer 15 is an apparatus responsible for the process of measuring the surface temperature of the joined steel strip S (temperature measurement process). In the manufacturing facility 1, based on the distance between the joining device 12 and the thermometer 15 and the transport speed of the joined steel strip S in the relevant section, the temperature of the joint portion is identified out of the temperature of the joined steel strip S continuously measured by the thermometer 15.

In the normal operating state, the joint portion of the joined steel strip S cools down as it passes through the looper 13, and reaches about the same temperature as that of the portions other than the joint portion in the joined steel strip S. Therefore, the temperature at any point in time measured continuously by the thermometer 15 may be handled as the temperature of the joint portion.

The cold roiling mill 16 is an apparatus responsible for the process of cold rolling (cold rolling process) in which the thickness of the joined steel strip S, for which the joint porton is heated by the heating device 14, is made to be a target thickness. Specifically, the cold rolling mill 16 is a tandem rolling mill having a plurality of rolling stands. The cold rolling mill 16 is equipped with five roiling stands in the present embodiment, but the number of rolling stands is not particularly limited.

The cutting machine 17 is an apparatus responsible for the process of cutting the joined steel strip S (cutting process) after cold rollng. The winding machine 18 is, for example, a carousel coiler and is an apparatus responsible for the process of winding (winding process) the steel strips cut by the cutting machine 17. The manufacturing facility may be equipped with a plurality of winding machines 18. In this case, the winding machines 18 wind a plurality of steel strips continuously.

The apparatuses included in the manufacturing facility 1 are not limited to the above-described apparatuses. The manufacturing facility 1 only needs to have the heating device 14 and the cold rolling mill 16 arranged in close proximity to each other (or more preferably adjacent to each other) in this order. Therefore, for example, when the cold rolling process and the pickling process, which is a prior process thereto, are continuous, a pickling device for pickling the joined steel strip S may be placed between the looper 13 and the cold rolling mill 16.

Details of Heating Process

Next, the details of heating (heating process) of a joint portion by the heating device 14 which is a feature of the present embodiment will be described. In the continuous cold rolling of the joined steel strip S, there is a need to cut the joint portion by the cutting machine 17 on the exit side of the cold rolling mill 16 and to separately wind the preceding steel strip and the following steel strip by the winding machine 18, so that the transport speed of the joined steel strip S needs to be reduced. As a result, the transport speed of the joined steel strip S on the exit side of the cold rolling mill 16 is extremely slow as compared with the steady portion. In the present embodiment, utilizing this situation, the jointed portion of the joined steel strip S is partially heated.

The specific heating means in the heating device 14 is not particularly limited, but in the present embodiment, the case in. which the heating device 14 is an induction heating device will be described as an example. Examples of heating means other than induction heating include an infrared heater, a hot water bath, and the like.

The heating device 14 determines a target output value of the heating device 14 based on the temperature of the joint portion measured by the thermometer 15, the target temperature of the joint portion on the exit side of the heating device 14, and the time that the joint portion passes through the heating device 14 (that is, heating time). The target temperature on the exit side of the heating device 14 may be the same temperature as the target temperature on the entrance side of the cold rolling mill 16 or may be higher than the target temperature on the entrance side of the cold rolling mill 16.

For example, when the heating device 14 and the cold rolling mill 16 are located at close positions (positions that are separated to the extent that the temperature of the joint portion does not substantially drop between the heating device 14 and the cold rolling mill 16), the target temperature on the exit side of the heating device 14 and the entrance side of the cold rolling mill 16 only needs to be equal. Meanwhile, when the heating device 14 and the cold rolling mill 16 are located at distant positions (positions that are separated to the extent that the temperature of the joint portion drops between the heating device 14 and the cold rolling mill 16), the target temperature of the joint portion on the exit side of the heating device 14 only needs to be set to a high temperature in consideration of the amount of temperature drop. From the viewpoint of production cost and productivity, it is preferable to arrange both as close as possible to each other. In this case, it is preferable that each apparatus is arranged so that the distance between the heating device 14 and the cold rolling mill 16 is closer than the distance between the looper 13 or the pickling device and the heating device 14.

In order to partially heat the joint portion rather than the entire joined steel strip S, it needs to identify the period during which the relevant joint portion passes through the heating device 14. The period during which the joint portion passes through the heating device 14 (the period from the time when the joint portion enters from the entrance side of the heating device 14 to the time when the joint portion exits from the exit side of the heating device 14) can be identified based on the distance between the joining device 12 and the heating device 14 and on the transport speed of the joined steel strip S in the relevant section.

Then, in the manufacturing facility 1, in the identified period, the state of the heating device 14 is switched to the output state so as to heat the passing object (that is, the joint portion) at the above-described target output value. In the manufacturing facility 1, the time t that is the time it takes from the output value 0 to the target output value is calculated so that, at the time T when the joint portion enters the entrance side of the heating device 14, the output value of the heating device 14 reaches the above-described target output value. Then, in the manufacturing facility 1, the time at which the heating device 14 is switched from the non-output state to the output state is set to T−t.

Furthermore, it is preferable that the heating device 14 be switched from the output state to the non-output state after the joint portion exited the heating device 14. Switching to the non-output state after the joint portion exited the heating device 14 can reliably heat the joint portion at the target output value. That is, strictly speaking, the heating device 14 heats not only the joint portion of the joined steel strip S but also the portions before and after the joint portion, depending on the switching time between the output state and non-output state.

As will be described later, it is desirable that the target output value in the heating device 14 be determined according to the Si content. When a plurality of steel strips having a different Si content are transported in the same device row, the heating device 14 only needs to acquire information indicating the Si content of the preceding steel strip and the following steel strip, to determine the target output value based on the relevant information, and to switch between the output state and the non-output state.

The heating device 14 heats at least one of the lower surface and the upper surface of the joined steel strip S, but it is more preferable to heat both the lower surface and the upper surface. In the present embodiment, the material to be roiled has been described as an electromagnetic steel sheet, but the type of steel sheet is not particularly limited. Examples of steel sheets to which the technology of the present invention can be suitably applied other than electromagnetic tee sheets include high-strength steel sheets and high-alloy steel sheets.

According to the cold-rolled steel strip manufacturing faclity 1 and the method for manufacturing cold-rolled steel strip in the present embodiment as in the foregoing, the heating device 14 is switched to the output state during the period when the joint portion passes through the relevant heating device 14, so that the fracture of the joint portion can be suppressed. Therefore, according to the cold-rolled steel strip manufacturing facility 1 and the method for manufacturing cold-rolled steel strip in the present embodiment, the occurrence of fracture of the joint portion can be suppressed during the cold rolling of a silicon steel strip, so that the joint portion or the silicon steel strip can be stably cold-rolled.

EXAMPLE

An example demonstrating the effect of the present invention will be described. In the present example, after welding the steel strip using a laser beam welder, the joint portion of the joined steel strip was heated using an 800 kW induction heating device on the entrance side of the cold rolling mill so as to be at the predetermined temperature indicated in Table 1 below ("entrance side joint portion temperature" in Table 1). Then, the joined steel strip after heating was cold-rolled by a 5-stand tandem mill to finish it to a predetermined thickness ("final thickness" in Table 1).

TABLE 1

| | Si Content (mass %) | | Thickness | | | Entrance side joint | | |
|---|---|---|---|---|---|---|---|---|
| | Preceding steel strip | Following steel strip | before rolling (mm) | Final thickness (mm) | Rolling reduction rate (%) | portion temperature (° C.) | Fractures occurrence rate (%) | Remarks |
| No. 1 | 0.9-1.2 | 0.9-1.2 | 1.8-2.4 | 0.3-0.5 | 75-83 | 10° C. | 0.5% | Reference example |
| No. 2 | 0.9-1.2 | 0.9-1.2 | 1.8-2.4 | 0.3-0.5 | 75-83 | 35° C. | 0.2% | Invention example |
| No. 3 | 0.9-1.2 | 0.9-1.2 | 1.8-2.4 | 0.3-0.5 | 75-83 | 50° C. | 0.1% | Invention example |
| No. 4 | 0.9-1.2 | 0.9-1.2 | 1.8-2.4 | 0.3-0.5 | 75-83 | 90° C. | 0.0% | Invention example |
| No. 5 | 2.6-2.9 | 2.6-2.9 | 1.8-2.4 | 0.3-0.5 | 75-83 | 10° C. | 3.1% | Comparative example |
| No. 6 | 2.6-2.9 | 2.6-2.9 | 1.8-2.4 | 0.3-0.5 | 75-83 | 35° C. | 2.8% | Invention example |
| No. 7 | 2.6-2.9 | 2.6-2.9 | 1.8-2.4 | 0.3-0.5 | 75-83 | 50° C. | 1.1% | Invention example |
| No. 8 | 2.6-2.9 | 2.6-2.9 | 1.8-2.4 | 0.3-0.5 | 75-83 | 90° C. | 0.2% | Invention example |
| No. 9 | 2.6-2.9 | 2.6-2.9 | 1.8-2.4 | 1.2-1.4 | 36-40 | 35° C. | 2.0% | Invention example |
| No. 10 | 3.2-3.5 | 3.2-3.5 | 1.8-2.4 | 0.3-0.5 | 75-83 | 10° C. | 7.3% | Comparative example |
| No. 11 | 3.2-3.5 | 3.2-3.5 | 1.8-2.4 | 0.3-0.5 | 75-83 | 35° C. | 4.8% | Comparative example |
| No. 12 | 3.2-3.5 | 3.2-3.5 | 1.8-2.4 | 0.3-0.5 | 75-83 | 50° C. | 1.9% | Invention example |
| No. 13 | 3.2-3.5 | 3.2-3.5 | 1.8-2.4 | 0.3-0.5 | 75-83 | 90° C. | 0.7% | Invention example |
| No. 14 | 0.9-1.2 | 2.6-2.9 | 1.8-2.4 | 0.3-0.5 | 75-83 | 35° C. | 2.6% | Invention example |
| No. 15 | 0.9-1.2 | 2.6-2.9 | 1.8-2.4 | 0.3-0.5 | 75-83 | 50° C. | 1.0% | Invention example |
| No. 16 | 3.2-3.5 | 2.6-2.9 | 1.8-2.4 | 0.3-0.5 | 75-83 | 35° C. | 4.5% | Comparative example |
| No. 17 | 3.2-3.5 | 2.6-2.9 | 1.8-2.4 | 0.3-0.5 | 75-83 | 50° C. | 1.7% | Invention example |

Five days was set as an evaluation period for each condition in which the temperature of the joint portion of the joined steel strip at the entrance side of the cold rolling mill was variously changed. Then, for 100 to 200 steel strips of each Si content that were cold-rolled during the evaluation period, the fracture occurrence rate (hereinafter described as "fracture rate") of the joint portion at the entrance side of the cold rolling mill was compared. As illustrated in Table 1, the fracture rate of the joint portion of the joined steel strip tends to be higher as the Si content is higher.

In Table 1, No. 1, 5, and 10 indicate examples in which heating of the joint portion of the joined steel strip by the induction heating device was not performed. In the same table, those having a fracture rate of below 3.0% (No. 2 to 4, 6 to 9, 12 to 15, and 17) are taken as invention examples, and those having a fracture rate of 3.0% or more (No. 5, 10, 11, and 16) are used as comparative examples. No. 1 is used as a reference example to illustrate an example in which the fracture rate is low even without performing the heating by the induction heating device if the Si content is low.

No. 1 to 4

No. 1 to 4 indicate examples of the cases in which the Si content of the preceding steel strip and the following steel strip is 1.2% or less. Under this condition, when heating was not performed by the induthon heating device (see No. 1), the fracture rate was relatively low. Meanwhile, when heating was performed by the induction heating device (see No. 2 to 4), the fracture rate was further reduced. In particular, when heating to 90° C. was performed by the induction heating device (see No. 4), the fracture rate was significantly reduced.

No. 5 to 9

No. 5 to 9 indicate examples of the cases in which the Si content of the preceding steel strip and the following steel strip exceeds 2% but is below 3%. Under this condition, when heating was not performed by the induction heating device (see No. 5), the fracture rate was relatively high. Meanwhile, when heating was performed by the induction heating device (see No. 6 to 9), the fracture rate was reduced. In particular, when heating to 50° C. or higher was performed by the induction heating device (see No. 7 and 8), the fracture rate was significantly reduced. In addition, when heating at the same heating temperature was performed by the induction heating device (see No. 6 and 9, for example), by lowering the roiling reduction rate (see No. 9, for example), the fracture rate could be reduced.

No. 10 to 13

No. 10 to 13 indicate the cases in which the Si content of the preceding steel strip and the following steel strip exceeds 3%. Under this condition, when heating was not performed by the induction heating device (see No. 10) and when heating to below 50° C. was performed by the induction heating device (see No. 11), the fracture rate was high. Meanwhile, when heating to 50° C. or hiaher was performed by the induction heating device (see No. 12 and 13), the fracture rate was reduced. In particular, when heating to 90° C. was performed by the induthon heating device (see No. 13), the fracture rate was significantly reduced.

No. 14 to 17

No. 14 to 17 indicate the cases in which the Si content of one of the preceding steel strip and the following steel strip exceeds 2%. Under this condition, when heating to 50° C. or higher was performed by the induction heating device (see No. 15 and 17), as compared with the cases in which heating to below 50° C. was performed (see No. 14 and 16), the fracture rate was reduced down to less than a half. As in No. 14 to 17, when the Si content differs between the preceding steel strip and the following steel strip, the heating temperature only needs to be set based on the steel strip having a higher Si content.

As in the foregoing, by applying the present invention and heating the joint portion of the joined steel strip at the entrance side of the cold rolling mill, weld fracture can be suppressed. In particular, when the Si content is 2% or more, by starting cold rolling at 50° C. or higher, the fracture rate can be significantly reduced, and thus, improvement in productivity and improvement in yield can be achieved.

As in the foregoing, the cold-rolled steel strip manufacturing facility and the method for manufacturing cold-rolled steel strip according to the present invention have been described specifically with reference to the embodiment and examples for carrying out the invention, but the spirit of the invention is not limited to these descriptions and has to be broadly interpreted based on the statement of the scope of the claims. Needless to say that various changes, modifications, and the like based on these descriptions are also included in the gist of the present invention.

REFERENCE SIGNS LIST

1 MANUTACTURING FACILITY
11 DISPENSING MACHINE
12 JOINING DEVICE
13 LOOPER
14 HEATING DEVICE
15 THERMOMETER
16 COLD ROLLING MILL
17 CUTTING MACHINE
18 WINDING MACHINE
S JOINED STEEL STRIP

The invention claimed is:

1. A cold-rolled steel strip manufacturing facility comprising:

a joining device configured to join a trailing end of a preceding steel strip and a leading end of a following steel strip to form a joined steel strip;

a looper configured to store the joined steel strip;

a heater configured to heat a joint portion between the preceding steel strip and the following steel strip over an entire width direction; and a cold rolling mill configured to cold-roll the joined steel strip for which the joint portion was heated by the heater, wherein the heater is switchable between an output state and a non-output state, and during a period in which the joint portion passes through the heater, is switched to the output state, and the heater is configured to heat the joint portion so that a temperature of the joint portion at an entrance side of the cold rolling mill is 50° C. or higher when a Si content of at least one of the preceding steel strip and the following steel strip is 2 mass % or more.

2. A method for manufacturing cold-rolled steel strip performing processes in sequence comprising:

a joining step of, by a joining device, joining a trailing end of a preceding steel strip and a leading end of a following steel strip to form a joined steel strip;

a storage step of, by a looper, storing the joined steel strip;

a heating step of, by a heater, heating a joint portion between the preceding steel strip and the following steel strip over an entire width direction; and a cold rolling step of, by a cold rolling mill, cold rolling the joined steel strip for which the joint portion was heated by the heater, wherein the heater is switchable between an output state and a non-output state, the heating step switches the heater to the output state, during a period in which the joint portion passes through the heater, and the heater is configured to heat the joint portion so that a temperature of the joint portion at an entrance side of the cold rolling mill is 50° C. or higher when a Si content of at least one of the preceding steel strip and the following steel strip is 2 mass % or more.

* * * * *